United States Patent [19]

Sevastakis

[11] 4,308,908

[45] Jan. 5, 1982

[54] METHODS AND APPARATUS FOR EFFECTING QUICK MANDREL CHANGES IN CONTINUOUS CASTING OPERATIONS

[76] Inventor: Gus Sevastakis, 5645 Angola Rd., Toledo, Ohio 43615

[21] Appl. No.: 112,239

[22] Filed: Jan. 15, 1980

[51] Int. Cl.[3] ..... B22D 11/00

[52] U.S. Cl. ..... 164/464; 164/137; 164/421; 164/340; 164/341

[58] Field of Search ..... 164/85, 137, 421, 422, 164/341, 340

[56] References Cited

U.S. PATENT DOCUMENTS

| | | | |
|---|---|---|---|
| 3,486,550 | 12/1969 | Yearley | 164/421 X |
| 3,578,065 | 5/1971 | Langer | 164/85 X |
| 3,698,470 | 10/1972 | Fink | 164/85 X |
| 4,154,291 | 5/1979 | Nielsen | 164/85 X |

*Primary Examiner*—Gus T. Hampilos
*Attorney, Agent, or Firm*—William E. Mouzavires

[57] ABSTRACT

In continuous casting of tubular products, the same die is used with mandrels of different sizes depending on the internal diameter of the tubular product to be cast. This avoids the necessity of dismanteling the casting "set-up" in order to remove a die and mandrel assembly when changing from casting a tubular product of one internal diameter to another of the same external diameter but different internal diameter. The mandrel and die are constructed so that the mandrel is releasable from the die after use to enable another mandrel to be inserted in the same die. During casting, the mandrel is maintained within the die against axial movement either by a thermocouple device positioned within the associated crucible to engage the top of the mandrel. The mandrel may be removed either manually or by a suitable tool engageable with the mandrel.

4 Claims, 4 Drawing Figures

METHODS AND APPARATUS FOR EFFECTING QUICK MANDREL CHANGES IN CONTINUOUS CASTING OPERATIONS

BACKGROUND OF INVENTION

In the art of continuous casting of tubular products, it is well-known to utilize a mandrel within a die and to pour molten metal into the die which flows into the space between the mandrel and the die and exits from the bottom of the die as a tubular product with the internal diameter being governed by the diameter of the mandrel. The external diameter of the tubular product is, of course, governed by the internal diameter of the die.

In setting apparatus for a casting operation, a cooler is mounted on a basic support structure or frame and the mandrel, once assembled in and fastened to the die, is placed in the cooler; it being understood that the cooler serves to cool the mandrel and die during casting which takes place at temperatures of approximately 2,200° F. A crucible is then placed above the die on a steel support plate with the die projecting through a bore in the bottom wall of the crucible. Prior to installing the crucible about the die, wet refractory material is applied around the die to form a seal together with refractory material that is later applied after installation of the crucible, between the steel supporting plate which supports the crucible and the crucible itself. A ceramic tundis shell is then placed around the crucible and a cover is placed on the top of the shell to retain heat within the crucible. The set-up is then ready for the prewarming during which time the crucible is heated and the wet refractory sealing material dries to form the desired seal. The prewarming period takes approximately one hour or more.

When the set-up is ready to initiate casting, the molten metal which has been poured into the crucible is at a temperature of approximately 2,200° F. When the molten metal initially enters the die, it engages a starter tip which had been previously positioned in the bottom of the die after installation in the cooler; the starter tip being fixed to the end of an elongated starter bar which projects downwardly from the die between the pinch rolls along the axis of the tubular product to be cast. Subsequently, the starter bar is lowered out of the die followed by the tubular cast product after which the portion of the cast product adjacent the starting bar is severed to remove the starting bar and tip. The casting continues until the desired amount of tubular product has been cast and it is desired to cast another tubular product of a different size or until the life of the die or mandrel ends, such as after approximately fifty (50) hours of continuous casting or if the die or mandrel become damaged.

When it is desired to replace the die and/or mandrel, the casting operation must be stopped, and in most instances the entire set-up allowed to cool to enable removal of the die and mandrel assembly as a unit; it being understood that with methods and apparatus of the prior art, the die and mandrel are usually permanently interconnected or fastened together once they are assembled. Once the set-up has cooled sufficiently, the crucible must be removed from the die requiring disruption of the refractory seal. In addition, the steel support plate over the cooler and under the crucible must be removed in order to permit a replacement die and mandrel assembly to be inserted in the cooler. After the used die is removed from the cooler, the cooler must be allowed to cool after which it must be refaced or sanded in order to provide a proper fit for the replacement die. Once the replacement die and mandrel assembly are inserted in the cooler, the crucible must again be mounted about the die and a new refractory seal applied between the die and the crucible followed by a warming period to bring the crucible up to the proper temperature. It should therefore be seen from the above that replacement of a die or a die and mandrel assembly is a time consuming process which not only lowers production but also involves waste of material and heat energy.

In situations where it is desired to convert a setup from casting a tubular product of one internal diameter to casting a tubular product of the same external diameter but of a different internal diameter, the methods and apparatus of the prior art require that both the mandrel and die once removed, be discarded entirely since they are exposed to oxidation and both united as a one-piece assembly. This is not only costly from the standpoint of wasting the die since the same die may be used for casting tubular products of different internal diameters but having the same external diameter but also, it suffers from the serious drawback that the entire assembly including the crucible, seal, die and cooler must be allowed to cool and then disassembled and then reassembled in the manner indicated above.

The prior art practices referred to above are those which utilize a mandrel supported in and by the die itself with the upper portions of both received in the bottom of the crucible. This die and mandrel assembly and its arrangement within the crucible are to be distinguished from open-ended dies utilized with mandrels such as, for example, disclosed in my U.S. Pat. No. 4,178,982, issued Dec. 18, 1979. In the latter type, the mandrel is not supported by the die but rather by an external structure. Also, the die and mandrel are not received in the crucible because the introduction of the molten metal takes place through the upper open end of the die.

OBJECTS OF THE PRESENT INVENTION

The present invention relates to continuous casting of elongated bars and is particularly suited to casting hollow bars although the invention is also applicable to casting solid bars. More specifically, the present invention relates to continuous casting of the type utilizing a mandrel located within and supported by a surrounding die with their upper portions received in the bottom of a crucible which supplies the molten metal to be cast through the die and mandrel.

It is an object of the present invention to provide method and apparatus for changing a continuous casting set-up of the type described for casting tubular products of different internal diameters, in a manner which is efficient and economical and which minimizes stoppage of production. Included herein are such method and apparatus which permit changeover from one mandrel to another to cast tubular products of a different internal diameter without requiring disassembly of the crucible, die, refractory seals between the crucible and the die, and the cooler assembly. Further included herein are such method and apparatus which permit changeover from casting a tubular product to casting a solid product or vice versa without requiring the aforementioned disassembly of the apparatus.

Another object of the present invention is to provide such method and apparatus which permit the same die to be used with different mandrels in different casting operations for casting tubular products of different internal diameters but the same external diameters. Included herein is the provision of a novel and improved die and mandrel assembly for a continuous casting operation which permits the mandrel to be removed from the die after use and replaced by another mandrel while retaining the same die.

Another object of the present invention is to provide an improved mandrel and die assembly for continuous casting of tubular products which assembly permits the relatively quick and easy removal of the mandrel from the die after a casting operation but without requiring disassembly of the crucible, die and cooler installation.

SUMMARY OF INVENTION

In accordance with the present invention, the die and mandrel are made so that the mandrel is either releasably fixed to the die or the mandrel is not fixed in any way to the die but rather, is releasably held within the die by an external tool. In the form of the invention wherein the mandrel is releasably fixed within the die, any suitable releasable connection may be used such as a pin and slot connection. In the other, preferred, form of the invention, the mandrel is simply positioned within the die without any positive fastening to the die, and a tool positioned in the crucible is brought into engagement with the top of the mandrel to hold it downwardly within the die during the casting operation. Preferably, this tool is the ceramic casing of a thermocouple which is positioned in the crucible to determine the temperature of the molten metal.

When it is desired to change the mandrel for casting tubular products having a different internal diameter but having the same external diameter corresponding to the internal diameter of the die, all of the molten metal in the crucible is "cast out" and then the mandrel is simply removed while leaving the die intact and another mandrel is inserted within the die. If it is desired to merely cast a solid bar of the same external diameter the same die is used without a mandrel of course.

In order to remove the mandrel from the die, a suitable tool may be used to grasp the mandrel and to pull it upwardly out of the die or instead, the mandrel may be removed manually with the use of an asbestos glove. In addition, a starter bar may be inserted through the bottom of the die into engagement with the bottom of the mandrel to facilitate removal of the mandrel if desired.

DRAWINGS

Other objects and advantages of the present invention will become apparent from the following more detailed description taken in conjunction with the drawings in which.

DETAILED DESCRIPTION

Figure 1:
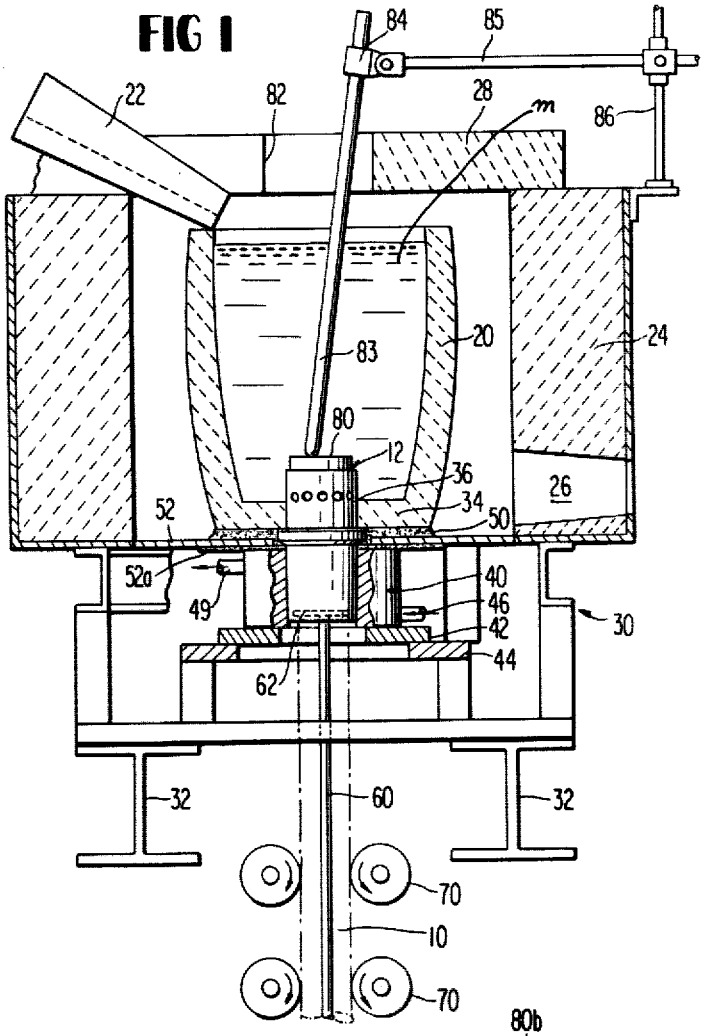
FIG. 1 is an elevational view, with portions in cross section, of a typical "set-up" or installation for the continuour casting of tubular products, the installation however incorporating an improved mandrel and die assembly in accordance with the present invention.

Referring now to the drawings in detail, there is shown for illustrative purposes in FIG. 1, a typical set-up or installation for the continuous vertical casting of tubular products, one product being illustrated in phantom lines and generally designated 10. The product 10 is formed from a die and mandrel assembly generally designated 12 in FIG. 1 but better illustrated in FIG. 2 wherein the die 14 is shown receiving mandrel 16 so that an annular space 18 is formed between the mandrel and the die for receiving molten metal which is formed into the tubular product with an external diameter conforming to the internal diameter of the die 14 and an internal diameter conforming to the external diameter of the mandrel 16 at a mid section thereof. In the specific die and mandrel shown, the molten metal m enters the die through apertures 15 formed radially through the die in communication with space 18 between the die and the mandrel 16. It should be understood, however, that in other die and mandrel assemblies that may be used in practicing the invention, the molten metal may be introduced through apertures in the mandrel.

Referring again to FIG. 1, a typical casting set-up includes of course a crucible 20 containing molten metal m which is introduced into the crucible by a suitable silicone pouring spout 22. Surrounding the crucible is a refractory tundis shell 24 having formed in the lower wall portion thereof, a fire nozzle port 26 through which a flame (not shown) is introduced into the tundis shell to heat the crucible and the molten metal therein to temperatures in the area of 2,200° F. On top of the tundis shell, is a ceramic or refractory cover 28 for retaining heat within the tundis shell; and the entire crucible and tundis shell assembly is supported on a tundis stand generally designated 30 which, in turn, is supported on a basic foundation structure in the form of two H-beams 32.

The bottom wall 34 of the crucible is provided with a cylindrical passage 36 for receiving the upper portion of the die and mandrel assembly with the flange 37 of the die engaging the undersurface of the bottom wall of the crucible, and with the upper portion of the die and mandrel assembly projecting into the lower end of the crucible as shown in FIG. 1.

The bottom portion of the die is received in a cooler generally designated 40 which is supported on a ring 42 which, in turn, rests on a suitable horizontal support structure 44 of the tundis stand which, in turn, is ultimately supported by the basic H-beam support structures 32. Cooler 40 is utilized to cool the die and in turn the product being cast and for this purpose, coolant entry and exit lines 46 and 49 are provided for circulating a coolant such as water through the cooler about the die.

A refractory mud seal 50 is provided about flange 37 of the die and between the bottom wall 34 of the crucible and an underlying horizontal support plate 52 which is also typically provided with a lower sheet **52*a*** of asbestos to protect the cooler.

In setting-up the aforementioned installation to initiate a casting operation, cooler 40 is first placed on support ring 42 and then the die and mandrel assembly are inserted within the cooler. The tundis shell 24 and its support plate 52 are installed and then crucible 20 is lowered about the die assembly 12 with the latter projecting upwardly through the passage 36 in the bottom wall 34 of the crucible. Mud seals 50 are then applied in wet condition and then crucible shell 24 is installed and its top substantially closed by cover 28. A flame is then introduced through the nozzle port 26 to prewarm the crucible to the desired temperature of approximately 2,200° F., the warming period taking place over the course of about one hour.

When the crucible shell is brought up to the desired temperature, molten metal m may then be introduced into the crucible through spout 22 to initiate the casting operation. Initially, a starter bar 60 having a starter tip 62 on its upper end is utilized to hold the molten metal when it is initially introduced into the die. The starter bar 60 is subsequently lowered along the axis of the eventual casting path of the product 10. After the starter tip 62 descends below the pinch rolls 70, the cast product 10 is severed above the starter tip 62 and the starter bar 60 is removed. The casting operation is continued with the pinch rolls 70 guiding the cast tubular product 10 downwardly in the proper vertical path.

In conventional mandrel and die assemblies of the prior art, once the mandrel is installed within the die, it is usually permanently fixed within the die by means of a pin which passes radially through the wall of the die and into a passage formed in the mandrel. Therefore, in order to change a casting set-up to cast a different tubular product having the same external diameter but a different internal diameter, it is necessary to remove the entire mandrel and die assembly and to replace it with another mandrel and die assembly. This is because conventional mandrel and die assemblies are permanently pinned to each other once they are assembled and the mandrel cannot be removed without destroying or seriously damaging the die. Since the die as well as the mandrel must be removed, it becomes necessary, among other requirements, to stop the casting operation and allow the set-up to cool to enable removal of the crucible including the tundis shell and removal of the mud seal. The installation of the replacement mandrel and die assembly again requires installation of the crucible and the tundis shell and the new mud seal. It will easily be seen that the above process results in stoppage of valuable production time and loss of heat energy.

In accordance with the present invention, the die and mandrel assembly are made so that the mandrel, once assembled in the die, may easily be released from the die to enable replacement with another mandrel without having to remove the die from the cooler which requires removal of the crucible and its surrounding shell. Thus instead of utilizing a permanent fastening pin or other mechanism for securing the mandrel in the die as has been done in the prior art, the mandrel and die assembly of the present invention are not permanently connected to each other but rather, a means is provided for releasably holding the mandrel in the die during the casting operation. In the preferred form of the invention shown in FIGS. 1 and 2, the mandrel 16 is simply received in the die with the flanged top or head 80 of the mandrel resting on the upper end of the die 81. No interconnecting fasteners are provided between the mandrel 16 and the die 14. The means for releasably holding mandrel 16 within die 14 during the casting operation, is a suitable tool which is placed through a port 82 typically provided in the cover 28 of the tundis shell 24; the tool extending down through the molten metal m and engaging the top of the head 80 of mandrel 16 as shown in FIG. 1. Preferably, the refractory casing tube shown as 83 in FIG. 1 of a thermocouple is utilized as the tool in the illustrated preferred embodiment. Although use of the thermocouple casing 83 is preferred, any other tools may be employed. It should be understood that the thermocouple and its casing 83 are themselves, of course, conventional and in FIG. 1 the casing 83 is shown as being supported in a suitable clamp 84 mounted to a horizontal support rod 85 which, in turn, is mounted on a vertical support 86 attached to the tundis shell 24 of the crucible. The thermocouple casing 83 may be raised in conventional fashion to release the mandrel 16 for removal and to permit another mandrel to be inserted in the die 14.

During a casting operation, when it is desired to produce tubular products having the same external diameter but a different internal diameter as that which is presently being cast, all that is required is to permit all of the molten metal m to "cast out" of the crucible and that the thermocouple casing 83 be raised to remove pressure on head 80 of mandrel 16 and to permit access thereto whereupon mandrel 16 is removed upwardly from the die 14 without disturbing the die or any other parts of the installation. Mandrel 16 may be actually removed by gripping it manually with an asbestos glove or with another tool such as tongs (not shown). In addition, the starter bar 60 with its starter tip 62 may be inserted through the bottom of the die 14 into engagement with the bottom of the mandrel 16 to facilitate upward removal of the mandrel 16 from the die 14.

Figure 2:
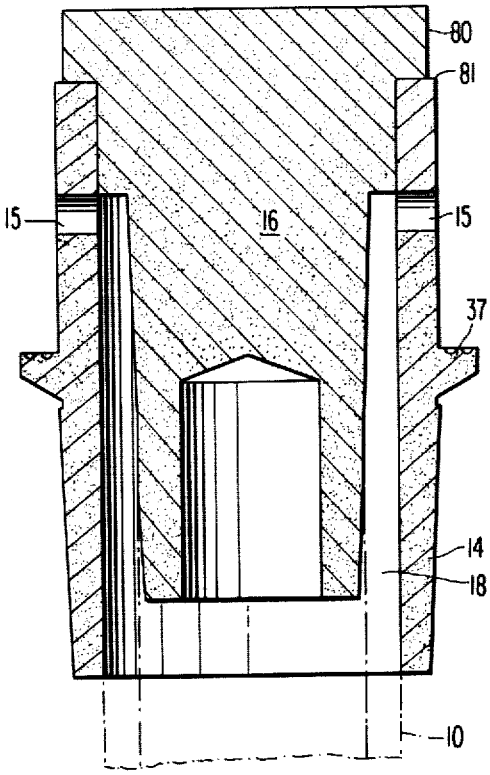
FIG. 2 is a cross-sectional, elevational, view of a die and mandrel assembly constructed in accordance with the present invention.
Figure 3:
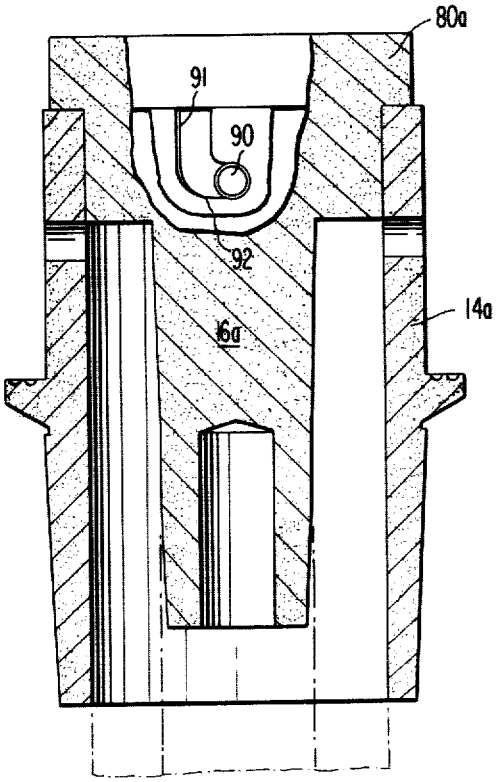
FIG. 3 is a view similar to FIG. 2 but illustrating another form of a mandrel and die assembly in accordance with the present invention and wherein the mandrel has a smaller diameter than the mandrel shown in FIG. 2.

Referring now to FIG. 3, another means is disclosed for releasably holding the mandrel **16*a* within the die 14*a*. This mechanism includes one or more pins 90 fixed to and projecting from the mandrel 16*a* to be received in one or more slots formed in the upper portion of the die 14*a* below its upper end with the slot opening into the upper end of the die. However, each slot has a generally L-shape including a vertical portion 91 and a horizontal portion 92 so that in order to releasably secure the mandrel within the die, the pin 90 is located in the lower horizontal portion 92. In order to remove the mandrel from the die, the mandrel 16*a* is slightly rotated to place the pin in the vertical portion 91 of the slot whereupon the mandrel may be vertically removed either manually or through the use of a tool in the manner described above in connection with the preferred embodiment of FIGS. 1 and 2**. Replacement of another mandrel simply required reversal of the above steps. In cases where two pin and slot connections are employed, it is preferred they be positioned at diametrically opposed locations.

The FIG. 3 embodiment also discloses a mandrel **16*a* having a smaller internal diameter than that of FIG. 2. Thus, with the mandrel of FIG. 3, the tubular products to be cast will have the same external diameter as that cast through the assembly shown in FIG. 2 but will have a smaller internal diameter than that of FIG. 2**.

Figure 4:
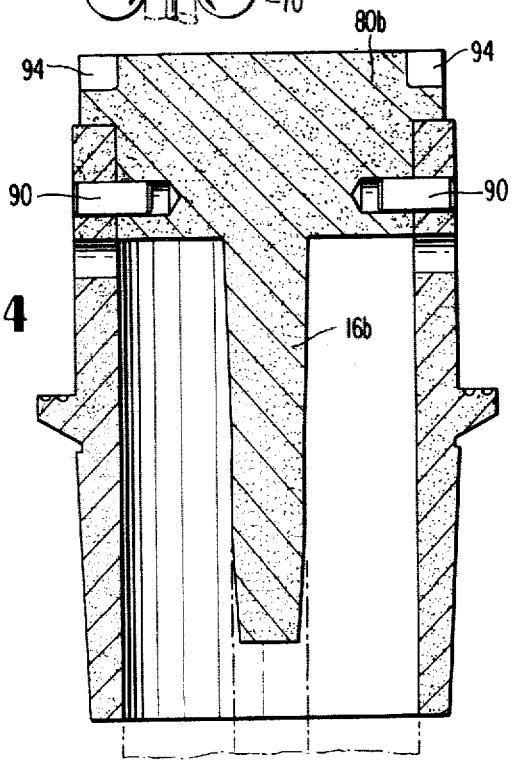
FIG. 4 is a view generally similar to FIG. 3 but illustrating another mandrel having a diameter less than the diameter of the mandrel shown in FIG. 3.

Referring now to FIG. 4, there is disclosed a die and mandrel assembly generally the same as FIG. 3 except that the mandrel **16*b* therein has even a smaller diameter than the mandrel 16*a* shown in FIG. 3, thus enabling tubular products to be formed with a smaller internal diameter. Also, FIG. 4 discloses a plurality of recesses 94 formed in the periphery of the head 80*b*** of the mandrel for receipt of a suitable tool (not shown) to enable removal or placement of the mandrel.

It will thus be seen that the present invention does away with the need of stopping production for relatively long periods in order to change from casting one tubular product to another having a different internal diameter. The present invention eliminates the need of cooling the crucible, removing the crucible shell and cover, and disrupting the mud seal in order to change to a different mandrel. It will also be obvious that the present invention is useful when interchanging mandrels having the same internal and external diameters such as is required when a mandrel becomes damaged or worn through use. Additionally, the present invention not only conserves heat energy but also the die which heretofore has been discarded and replaced with a new die each time the mandrel was changed. Finally it will be seen that the present invention also permits simple conversion to casting a solid bar from casting a hollow bar or vice versa without requiring disassembly of the casting "set-ups".

What is claimed is:

1. In the art of continuous vertical casting of tubular products utilizing a die and a mandrel within and supported by the die, and a crucible for holding molten metal to be cast with upper portions of said mandrel and die being received in the crucible and wherein one of said mandrel and die has flow passages for conveying molten metal from the crucible to the space between the mandrel and the die, the method comprising the steps of providing a releasable mandrel within and supported by said die to permit removal of the mandrel from the die while the die remains installed for continuous casting, continuously casting molten metal introduced from the crucible between the mandrel and the die, and releasably holding the mandrel within the die by means of a tool engageable with the top of the mandrel, said step of releasably holding the mandrel including the step of utilizing a thermocouple device as the tool for releasably holding the mandrel within the die.

2. In the art of continuous vertical casting of tubular products utilizing a die and a mandrel within and supported by the die, and a crucible formed separately from the die for holding molten metal to be cast with upper portions of said mandrel and die being received in the crucible and wherein one of said mandrel and die has flow passages for conveying molten metal from the crucible to the space between the mandrel and the die and wherein a seal is established between the crucible and the die, the method comprising the steps of releasably holding the mandrel within the die to permit removal of the mandrel from the die while the die remains installed for continuous casting, vertically continuously casting a tubular product from molten metal introduced from the crucible between the mandrel and the die, casting out through the die all of the molten metal in the crucible, releasing the mandrel, withdrawing the mandrel upwardly from the die through the crucible while leaving the crucible, the seal and the die in tact, installing another mandrel into the die through the crucible while leaving the die in tact, introducing molten metal into the crucible and resuming continuous vertical casting through means of the newly installed mandrel and the said die, and wherein the method further includes the step of releasably holding the mandrel within the die by means of a tool separate from the mandrel and extending into the crucible to be engageable with the top of the mandrel, and wherein the method further includes the step of utilizing a thermocouple device as the tool for releasably holding the mandrel within the die.

3. In apparatus for continuously casting tubular products wherein the apparatus includes a die having a through passage extending between upper and lower ends thereof, a mandrel received in and supported by the die and defining with the die an annular space between the mandrel and the die for receiving molten metal to form the tubular product, means including a crucible for introducing molten metal in the die into the space between the mandrel and the die and upper portions of the mandrel being received in the crucible; the improvement wherein said mandrel is releasably received in the die and there is included releasable means for releasably holding the mandrel within the die during a casting operation, said releasable means being releasable to permit axial withdrawal of the mandrel from the die, and wherein said releasable means includes a tool extending within the crucible and releasably engaging the mandrel to hold the mandrel downwardly within the die during a casting operation, said tool being a thermocouple device used to measure temperature within the crucible.

4. In apparatus for continuous vertical casting of tubular products wherein the apparatus includes a die having a through passage extending between upper and lower ends thereof, a mandrel received in and supported by the die and defining with the die an annular space between the mandrel and the die for receiving molten metal to form the tubular product, means including a crucible sealed about the die for introducing molten metal in the die into the space between the mandrel and the die, and wherein upper portions of the mandrel are received and terminate in the crucible; the improvement wherein said mandrel is releasably received in the die and there is included releasable means for releasably holding the mandrel within the die during a casting operation, said releasable means being releasable to permit axial withdrawal of the mandrel from the die and wherein said releasable means includes a tool separate from the mandrel, extending into the crucible and releasably engaging the mandrel to hold the mandrel downwardly within the die during a casting operation, and wherein said tool is a thermocouple device used to measure temperature within the crucible.

* * * * *